US006006998A

United States Patent [19]

Rerolle

[11] Patent Number: 6,006,998

[45] Date of Patent: Dec. 28, 1999

[54] APPARATUS FOR HEATING A BUILDING USING A HEAT PIPE

[75] Inventor: Michel Rerolle, Lyons, France

[73] Assignee: Societe Generfeu, Vaulex en Velin, France

[21] Appl. No.: 09/043,178

[22] PCT Filed: Oct. 13, 1995

[86] PCT No.: PCT/FR95/01358

§ 371 Date: Mar. 16, 1998

§ 102(e) Date: Mar. 16, 1998

[87] PCT Pub. No.: WO97/14002

PCT Pub. Date: Apr. 17, 1997

[51] Int. Cl.[6] ..... F24H 9/06

[52] U.S. Cl. ..... 237/70; 237/8 B

[58] Field of Search ..... 237/70, 67, 8 B, 237/69

[56] References Cited

U.S. PATENT DOCUMENTS

| | | | |
|---|---|---|---|
| 1,011,880 | 12/1911 | Baerenklau | 237/73 |
| 2,068,549 | 1/1937 | Knight | 237/59 |
| 2,146,148 | 2/1939 | Knipper | 237/59 |
| 2,246,802 | 6/1941 | Kehm et al. | 237/59 |
| 4,061,131 | 12/1977 | Bohanon | 237/67 |
| 4,582,042 | 4/1986 | Kubler | 237/70 |
| 4,613,071 | 9/1986 | Omori | 237/67 |

FOREIGN PATENT DOCUMENTS

| | | |
|---|---|---|
| 2320501 | 3/1977 | France . |
| 2725499 | 4/1996 | France . |
| 764280 | 12/1956 | United Kingdom . |
| 785767 | 12/1957 | United Kingdom . |

*Primary Examiner*—Henry Bennett
*Assistant Examiner*—Derek S. Boles
*Attorney, Agent, or Firm*—Oliff & Berridge, PLC

[57] ABSTRACT

An apparatus, based on a heat pipe, is provided for heating a building having at least one enclosed space that is bounded by a wall. The apparatus includes a plurality of passive heat transfer modules distributed along a dimension of the building and a hot source. Each passive heat transfer module includes a closed volume filled with two-phrase heat transfer fluid, at least one evaporator located outside of the enclosed space, downwardly directed heaters formed from a condenser tube, and an adiabatic circuit connecting an outlet of the evaportor and an inlet of the condenser tube. The heaters are spaced from the evaporator and located inside and at a top of the enclosed space to be heated. The hot source is located outside of the enclosed space to be heated but in heat exchange relationship with the evaporator. The hot source includes a lagged duct for the flow of a gas stream at high temperature and the adiabatic circuit passes through the wall of the enclosed space to be heated.

20 Claims, 2 Drawing Sheets

APPARATUS FOR HEATING A BUILDING USING A HEAT PIPE

BACKGROUND OF THE INVENTION

The present invention relates to the heating of a building, and more particularly of a building for industrial use, for example a workshop.

Document FR-A-2,320,501 has described and proposed an apparatus for heating a building using a heat pipe, for example a dwelling, consequently comprising several enclosed spaces or rooms to be heated, each bounded by a wall or equivalent separating means. This heating apparatus comprises a passive heat transfer module or system, forming a closed volume filled with a two-phase heat transfer fluid, for example a fluoro-chlorinated hydrocarbon. This module comprises, at a low end, an evaporator, located outside the enclosed space or room to be heated, a condenser located at the top inside the same enclosed space, and an adiabatic circuit connecting the outlet of the evaporator to the inlet of the condenser, passing through the wall of the enclosed space to be heated, said adiabatic circuit being designed to pass the evaporated heat transfer fluid from the evaporator to the condenser and to return the condensed same fluid from the condenser to the evaporator, all this by means of a column arranged as a heat pipe. The heating means located inside the enclosed space to be heated are solely of the convective type and are thermally coupled to the condenser.

The apparatus described above appears to be unsuitable for heating an industrial building.

Document GB-A-764,280 has described an apparatus for heating using a heat pipe, which comprises, as previously:

(a) a passive heat transfer module forming a closed volume filled with a two-phase heat transfer fluid, comprising at least one evaporator, at least one condenser and an adiabatic circuit, connecting the outlet of the evaporator and the inlet of the condenser, said adiabatic circuit being designed to pass the evaporated heat transfer fluid from the evaporator to the condenser and to return the condensed heat transfer fluid from the condenser to the evaporator;

(b) a hot source in heat exchange with the evaporator;

(c) heating means thermally coupled to the condenser consisting essentially of means for heating the air or ambient atmosphere convectively.

SUMMARY OF THE INVENTION

It is known that convective means turn out to be not very effective for heating an enclosed space of large volume, for example of the workshop type.

The subject of the present invention is therefore an apparatus for heating using a heat pipe, making it possible to heat a building with a satisfactory thermal efficiency which is superior to that using conventional heating means.

In accordance with the invention, the heating means are located at the top of the enclosed space to be heated, are directed downward and combine a thermal-radiation radiative structure which has a relatively large developed surface area, thermally coupled to the condenser, and means for thermally insulating said radiative structure which are located above the condenser and said structure and are dimensioned, with respect to one another, so that the heat radiatively emitted by said heating means represents at least 80% of the heat produced by said means.

BRIEF DESCRIPTION OF THE DRAWING

The present invention will now be described with reference to the appended drawing, in which.

DETAILED DESCRIPTION OF EMBODIMENTS

Figure 1:
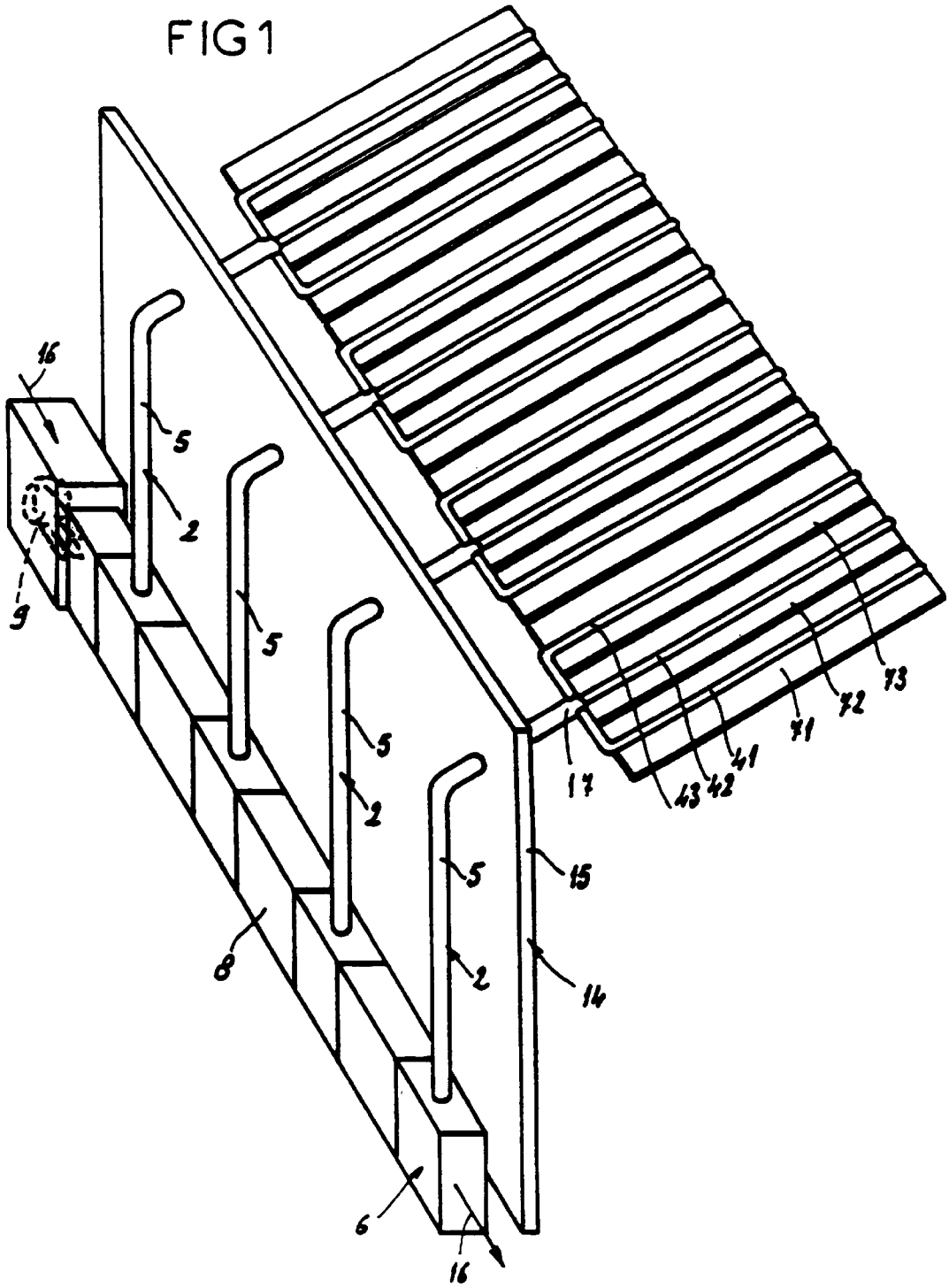
FIG. 1 depicts diagrammatically, with partial cutaway, a building equipped with a heating apparatus according to the present invention.

FIG. 1 depicts a building 14, the roof of which has been removed for the sake of the drawing, having a wall 15 which delimits, on the inside, an enclosed space 1 to be heated. Depending on the length of the building 14, several (in this case four) passive heat transfer modules 2 according to the invention are distributed so as to heat the inside of the building uniformly. The wall 15 of the enclosed space is shown diagrammatically in FIG. 2 by the dot-dash line.

Figure 2:
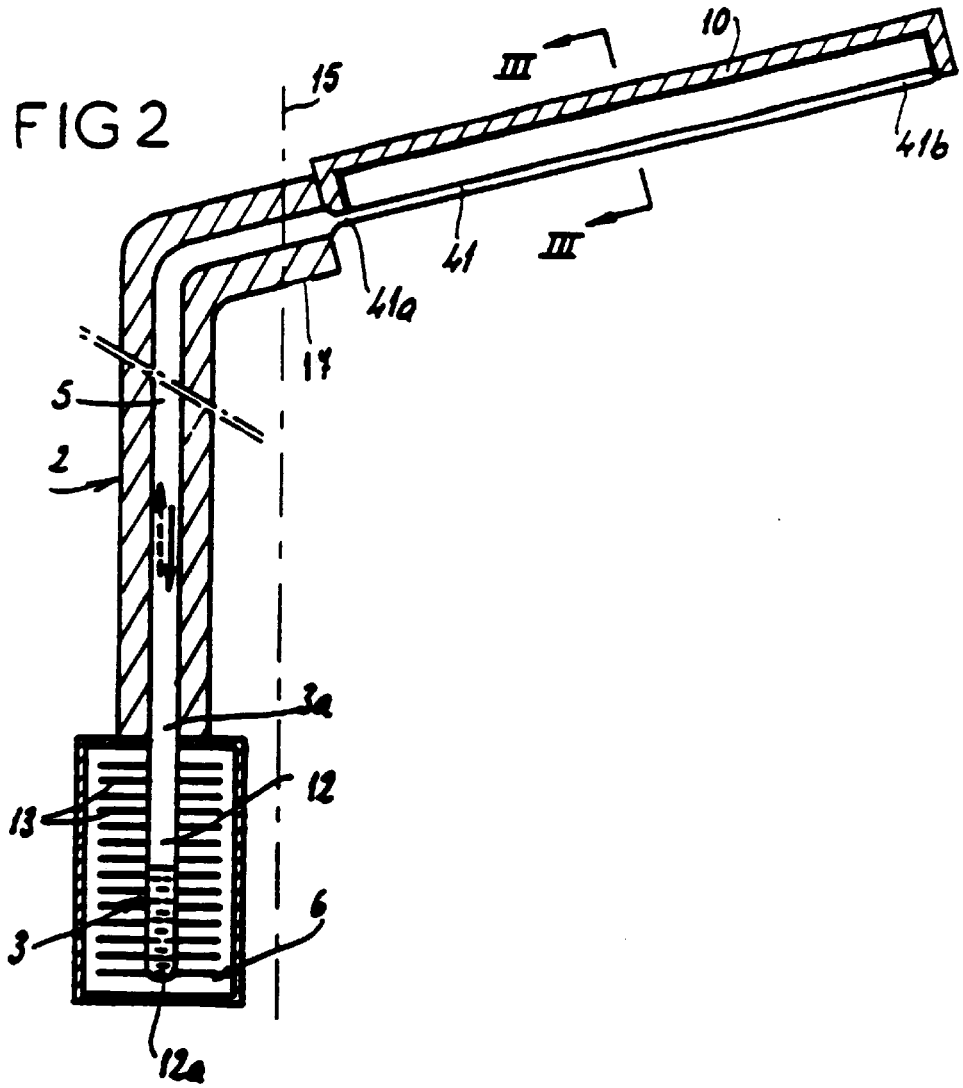
FIG. 2 depicts, again diagrammatically, a passive heat transfer module forming part of the heating apparatus depicted in FIG. 1.

According to FIG. 2, each passive heat transfer module 2 forms a closed volume filled with a two-phase heat transfer fluid, in this case water in the form of liquid and vapor. Each module 2 is located on each side of the wall 15 of the enclosed space to be heated 1, and therefore both outside and inside the building 14, and in general comprises:

an evaporator 3, optionally located outside the enclosed space 1 to be heated, and more specifically inside a lagged duct 8 for the flow of a gas stream at high temperature, the duct itself lying outside the building 14;

three condensers 41, 42 and 43, supplied via the same distributor 17, these being located inside the enclosed space 1, and more particularly at the top of the building 14, under the roof (not depicted) and following approximately the slope of the latter;

an adiabatic circuit or pipe 5 passing through the wall 15 of the enclosed space to be heated, connecting the outlet 3*a* of the evaporator 3 to the inlets 41*a*, 42*a* and 43*a* of the condensers 41, 42 and 43 respectively, via the distributor 17, said circuit being designed to pass the evaporated heat transfer fluid from the evaporator 3 to the aforementioned condensers and to return the condensed heat transfer fluid as a countercurrent from the condensers 41 to 43 to the evaporator 3.

The lagged duct 8 for the flow of the gas stream at high temperature constitutes a hot source 6 common to all the passive heat transfer modules 2. For this purpose, the evaporators 3 of the four heat transfer modules 2 are located in the lagged duct 8, in heat exchange with the gas stream flowing in the latter. A burner 9, for example one burning a combustible gas, is located at one end of the flow duct 8, upstream of all the evaporators 3. Thus, with an intake of ambient air from the atmosphere, a gas stream at high temperature flows in the duct 8 in the direction and sense which are established by the arrows 16.

Figure 3:
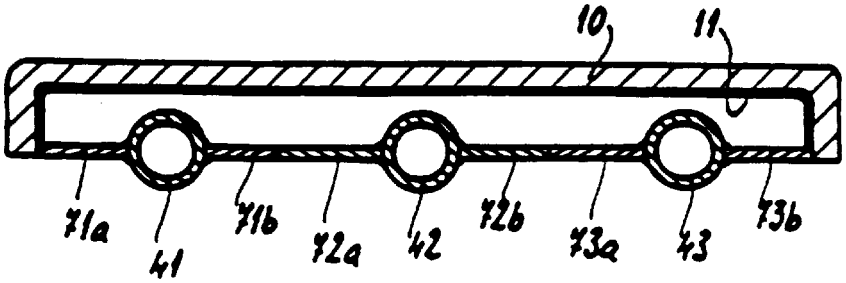
FIG. 3 depicts, in cross-section on the line III—III of FIG. 2, the heating means forming part of the passive heat transfer module depicted in FIG. 2.

According to FIG. 2, each passive heat transfer module 2 comprises heating means located at the top of the enclosed space 1 to be heated, and directed downward. Each heating means combines a radiative structure 71, 72 or 73 designed to radiate thermally, downward, having a relatively large developed surface area, and thermally coupled, for example conductively, to a condenser 41, 42 or 43 respectively. More specifically, as shown in FIGS. 1 through 3, each condenser 41 comprises a tube closed at one end, 41*b*. Condensers 42 and 43 have like structure (unshown). The radiative structures 71, 72 and 73 each comprise two metal flanges, 71*a* and 71*b* or 72*a* and 72*b* or 73*a* and 73*b,* located on each side of the aforementioned tube and thermally connected conductively to the latter. As shown in FIG. 3, means 10 for thermally insulating each radiative structure 71, 72 and 73 are located above the condenser 41, 42 and 43 respectively, and above the radiative structure 71, 72 and 73 of the same passive heat transfer module 2. The condensers 41, 42 and 43, the radiative structures 71, 72 and 73 and the thermal insulation means 10 are dimensioned, with respect to one another, so that the heat emitted radiatively by the heating means represents at least 80% of the heat produced by said heating means.

The evaporator 3 of each heat transfer module 2 comprises a tube 12 closed at one end, 12*a,* located transversely, for example vertically, in the duct 8 for the flow of the gas stream at high temperature, a plurality of fins 13 lying perpendicular to the axis of the closed tube 12.

It stems from the above description that each passive heat transfer module 2 behaves as a thermosyphon, comprising the evaporator 3, at one end and at a low level, and three condensers 41 to 43 located, with their respective radiative structures 71 to 73, at the other end and at a high level. The evaporator 3 and the aforementioned condensers are connected together by the adiabatic pipe 5 and the distributor 17 in order for the vapor phase of the heat transfer fluid to rise (along the direction of the dotted arrow) and for the liquid phase of the heat transfer fluid to fall as a countercurrent (along the direction of the solid-line arrow).

According to the present invention, the heat transfer fluid and the internal pressure in each passive heat transfer module 2 are determined in order to establish, in operation:

a predetermined temperature of between 110° C. and 250° C., and preferably of between 140° C. and 160° C., for example 150° C., in the condenser; and a temperature of between 400° C. and 600° C., and preferably between 450° C. and 550° C., for example 500° C., in the evaporator 3.

Preferably, each heat transfer module 2 is dimensioned so as to correspond to the following characteristics:

the closed volume being at most equal to 25 liters, the bore of the adiabatic circuit or pipe 5 is between 3 and 4 cm;

the overall length of the module 2, i.e. the developed length from the evaporator 3 to the condensers 41 to 43, is less than or equal to 15 m.

I claim:

1. An apparatus for heating a building having at least one enclosed space to be heated that is bounded by a wall, said apparatus comprising:

a) a plurality of passive heat transfer modules distributed along a dimension of the building, each passive heat transfer module comprising a closed volume filled with a two-phase heat transfer fluid, said module including at least one evaporator; downwardly directed heating means spaced from said evaporator and located inside and at a top of the enclosed space to be heated, said heating means including a condenser tube closed at one end, a radiative flange located on one side of and conductively connected to said condenser tube, and thermal insulating means located above said condenser tube and said radiative flange; and an adiabatic circuit connecting an outlet of said evaporator and an inlet of said condenser tube, said adiabatic circuit passing evaporated heat transfer fluid from said evaporator to said condenser tube and returning condensed heat transfer fluid from said condenser tube to said evaporator; and (b) a hot source located in heat exchange relationship with the evaporator, said hot source comprising a lagged duct for the flow of a gas stream at high temperature, located outside of the enclosed space to be heated, and the evaporator is located in heat exchange relationship with the gas stream, wherein said evaporator and said hot source are located outside of said enclosed space, the at least one evaporator of each of the passive heat transfer modules is respectively located in said lagged duct for the flow of the gas stream at high temperature, said adiabatic circuit passes through the wall of the enclosed space to be heated, and the condenser tube and the heating means are located inside and at the top of the enclosed space to be heated.

2. The apparatus according to claim 1, wherein a burner is located at one end of said lagged duct, upstream from said evaporator.

3. The apparatus according to claim 1, wherein said evaporator comprises at least one tube closed at one end and located transversely in the lagged duct, and a plurality of fins lying perpendicular to an axis of said at least one tube of said evaporator.

4. The apparatus according to claim 1, wherein the heat transfer fluid and internal pressure in said passive heat transfer module provide a condenser temperature of between 110° C. and 250° C.

5. The apparatus according to claim 4, wherein the condenser temperature is between 140° C. and 160° C.

6. The apparatus according to claim 4, wherein the condenser temperature is about 150° C.

7. The apparatus according to claim 4, wherein the heat transfer fluid and the internal pressure in the passive heat transfer module provide an evaporator temperature of between 400° C. and 600° C.

8. The apparatus according to claim 4, wherein the heat transfer fluid and the internal pressure in the passive heat transfer module provide an evaporator temperature of between 450° C. and 550° C.

9. The apparatus according to claim 4, wherein the heat transfer fluid and the internal pressure in the passive heat transfer module provide an evaporator temperature of about 500° C.

10. The apparatus according to claim 1, wherein said passive heat transfer module comprises one evaporator at one end of said module and a plurality of said heating means at the other end of said module, said condenser tubes of said plurality of heating means all being connected by a common distributor to said adiabatic circuit.

11. The apparatus according to claim 1, wherein said passive heat transfer module has a closed volume of no more than 25 liters and a bore of said adiabatic circuit is between 3 cm and 4 cm in diameter.

12. The apparatus according to claim 1, wherein an overall length of said passive heat transfer module from said evaporator to said condenser is less than or equal to 15 m.

13. An apparatus for heating a building having at least one enclosed space to be heated that is bounded by a wall, said apparatus comprising:

a) at least one passive heat transfer module comprising a closed volume filled with a two-phase heat transfer fluid, said module including at least one evaporator including at least one tube closed at one end and a plurality of fins lying perpendicular to an axis of said at least one tube of the evaporator; downwardly directed heating means spaced from said evaporator and located inside and at a top of the enclosed space to be heated, said heating means including a condenser tube closed at one end, a radiative flange located on one side of and conductively connected to said condenser tube, and thermal insulating means located above said condenser tube and said radiative flange; and an adiabatic circuit connecting an outlet of said evaporator and an inlet of said condenser tube, said adiabatic circuit passing evaporated heat transfer fluid from said evaporator to said condenser tube and returning condensed heat transfer fluid from said condenser tube to said evaporator; and (b) a hot source located in heat exchange relationship with the evaporator, said hot source comprising a lagged duct for the flow of a gas stream at high temperature, located outside of the enclosed space to be heated, and the evaporator is located in heat exchange with the gas stream, wherein said evaporator and said hot source are located outside of said enclosed space, said adiabatic circuit passes through the wall of the enclosed space to be heated, and the at least one tube is located transversely in the lagged duct.

14. The apparatus according to claim 13, wherein a burner is located at one end of said lagged duct, upstream from said evaporator.

15. The apparatus according to claim 13, wherein the heat transfer fluid and internal pressure in said passive heat transfer module provide a condenser temperature of between 110° C. and 250° C.

16. The apparatus according to claim 15, wherein the condenser temperature is between 140° C. and 160° C.

17. The apparatus according to claim 15, wherein the heat transfer fluid and the internal pressure in the passive heat transfer module provide an evaporator temperature of between 400° C. and 600° C.

18. The apparatus according to claim 15, wherein the heat transfer fluid and the internal pressure in the passive heat transfer module provide an evaporator temperature of between 450° C. and 550° C.

19. The apparatus according to claim 13, wherein said passive heat transfer module comprises one evaporator at one end of said module and a plurality of said heating means at the other end of said module, said condenser tubes of said plurality of heating means all being connected by a common distributor to said adiabatic circuit.

20. The apparatus according to claim 13, wherein said passive heat transfer module has a closed volume of no more than 25 liters and a bore of said adiabatic circuit is between 3 cm and 4 cm in diameter.

* * * * *